United States Patent [19]

Neitzel et al.

[11] 3,962,846

[45] June 15, 1976

[54] APPARATUS FOR AUTOMATIC WRAPPING OF BALES

[75] Inventors: Joseph C. Neitzel, Sao Paulo, Brazil; Ronald A. Tomlinson, Garland; Allen R. Hurst, Jr., Denison, both of Tex.; Paul W. Bodovsky; Arnold E. Krueger, both of Sherman, Tex.

[73] Assignee: Hardwicke-Etter Company, Sherman, Tex.

[22] Filed: Feb. 12, 1975

[21] Appl. No.: 549,156

Related U.S. Application Data

[63] Continuation-in-part of Ser. No. 437,515, Jan. 28, 1974.

[52] U.S. Cl. ..... 53/124 C; 100/223

[51] Int. Cl.[2] ..... B65B 63/02

[58] Field of Search ..... 53/24, 124 C; 100/223, 100/DIG. 15

[56] References Cited

UNITED STATES PATENTS

| | | | |
|---|---|---|---|
| 2,175,075 | 10/1939 | Blewett | 100/223 |
| 3,030,750 | 4/1962 | Lowe et al. | 53/124 C |
| 3,040,653 | 6/1962 | Neitzel | 100/223 X |
| 3,343,334 | 9/1967 | Bode et al. | 53/124 C |
| 3,525,192 | 8/1970 | Merkel et al. | 53/24 X |
| 3,816,970 | 6/1974 | Van Doorn et al. | 53/124 C |

*Primary Examiner*—Travis S. McGehee
*Attorney, Agent, or Firm*—Bertram H. Mann

[57] ABSTRACT

Wrapping sheets are propelled across the opposed platens of a baling press. After compression, the press box is removed from the bale, and thereafter wrapper folding members move along the bale walls to fold the freed edge portions of the wrapping sheets thereagainst. Finally, while the folds are held, securing bands are applied about the bale which is then released and removed.

20 Claims, 27 Drawing Figures

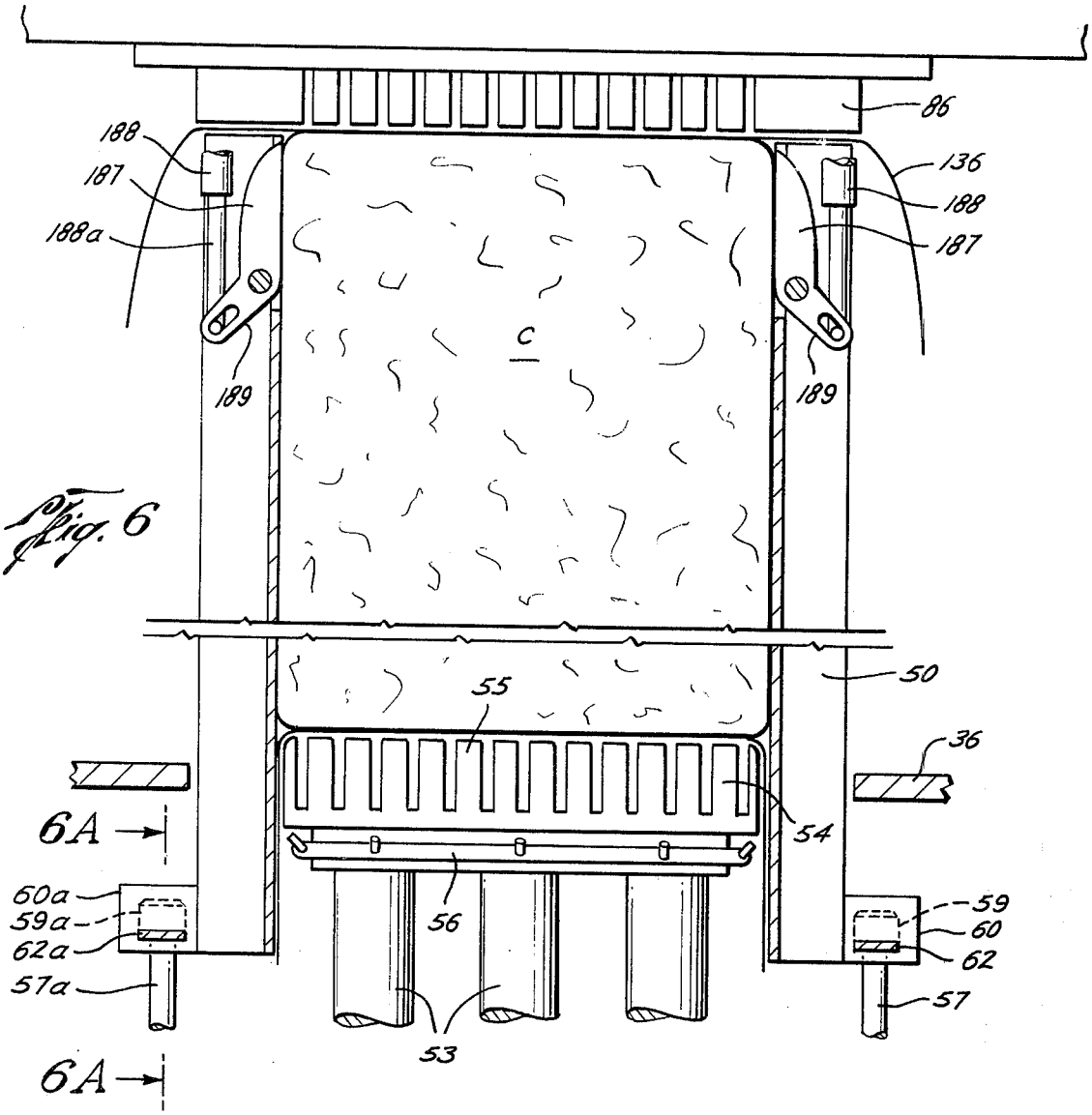
Fig. 6
Fig. 6A
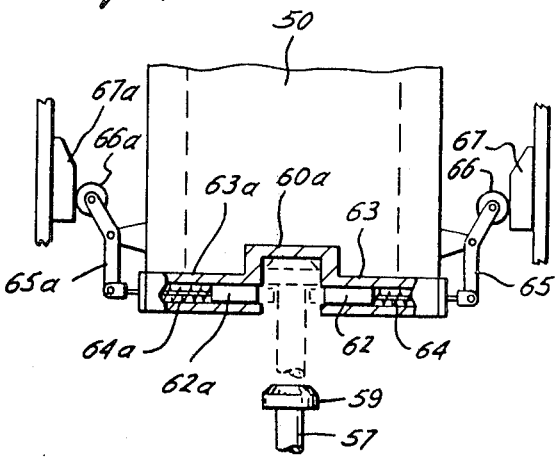
Fig. 7
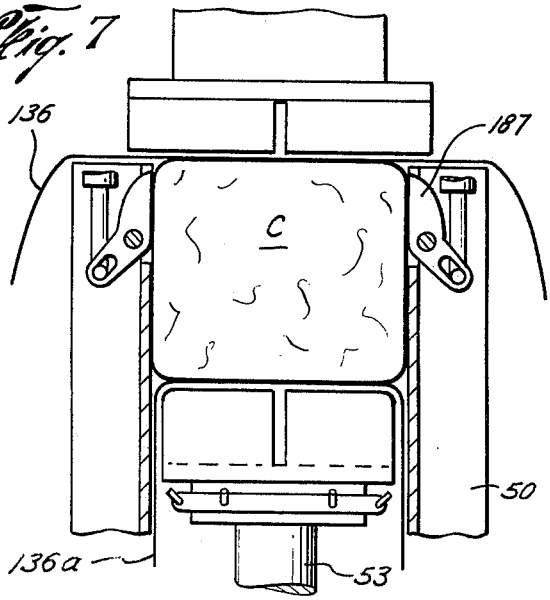

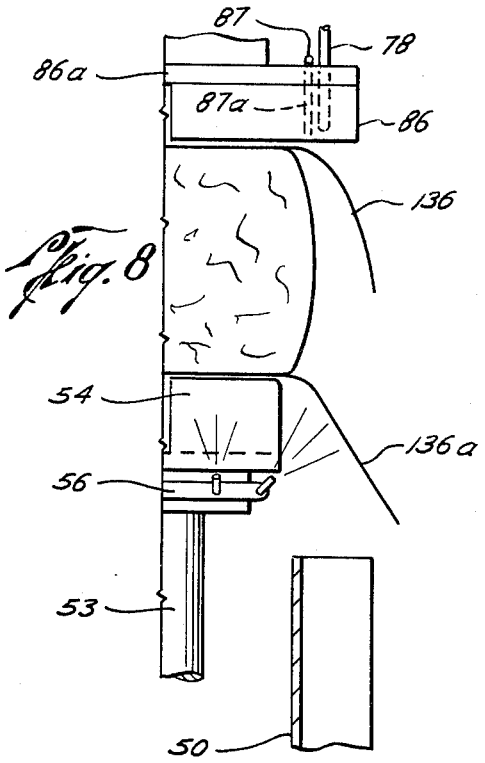
Fig. 8
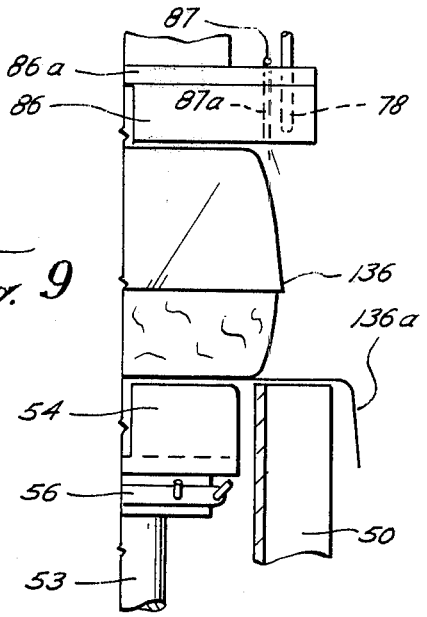
Fig. 9
Fig. 10
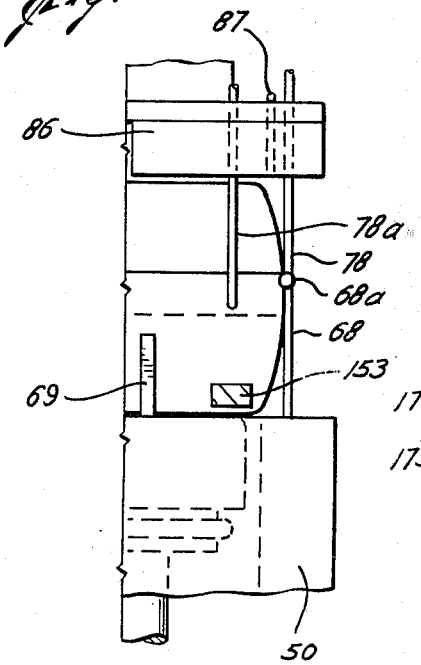
Fig. 11
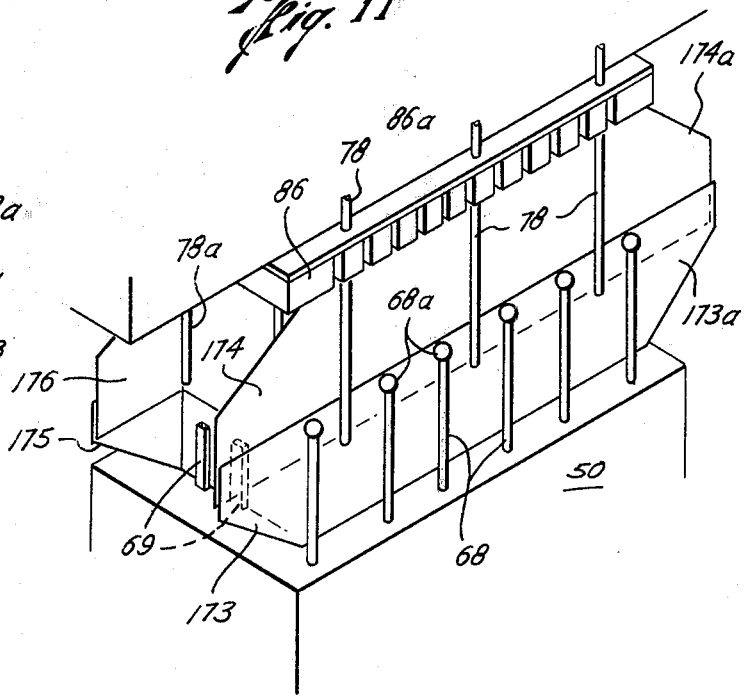

72
72
74
77
79
76
78
80
73
73c
73a
73b
75
78
86
68a
68b
71a
68
68
71
178
70

APPARATUS FOR AUTOMATIC WRAPPING OF BALES

RELATED APPLICATION

This application is a continuation-in-part of our application Ser. No. 437,515 filed Jan. 18, 1974.

BACKGROUND OF THE INVENTION

This invention relates to baling presses and consists of novel apparatus and method steps for automatically wrapping pressed bales of fibrous materials.

Heretofore, the application of protective wrappings to bales, for instance, of textile fibers, has required manual placing of the wrapping sheets across the press platens and folding of the sheets about the bale side and end faces by workmen after compression and separation of the press box walls from the bale. These manual steps, even though other steps, as tramping, compacting, and banding, may be automatically or semiautomatically performed, obviously increase the cost as well as the time required for the baling operation.

Consequently, an object of the present invention is to provide automatic means for applying protective wrappings to bales of compressed fibers and the like.

A more specific object is to construct a baling press of the two-box type incorporating automatic means for applying, folding, and securing wrapping sheets about the formed bales, preparatory to banding.

SUMMARY OF THE INVENTION

A two-box baling press has a pair of movable doorless boxes vertically slidable in the opposite sides of a rugged frame which rotates between a first position for receiving a charge of fibers from a tramper, as of the overhead type, and a second position above an uppacking ram. The box in the second position is located between and aligned with press platens which are normally spaced from the box ends. Wrapper supporting tables are mounted in the spaces between the platens and box ends with apertures or windows registering therewith. Rolls of wrapping material are conveniently mounted in association with means for propelling the material across the table openings. Properly sized individual sheets are then severed. Next, in order, the bottom doors which support the charge in the box are released to drop the charge onto the severed bottom sheet and platen, the bottom platen is moved into the box approximately to the position of the charge supports, the bottom platen and the box are elevated together to catch the top wrapper sheet on the box and move the sheet and the top of the box against and abreast of the top platen, and then the bottom platen is moved into the box to compress the charge. Next the box is shifted downwardly to clear the bale. The top and bottom folding members are moved vertically along the exposed side and end walls of the bale, catching the freed wrapper sheet edges and laying them neatly against the bale walls. Other wrapper folding members move horizontally along the bale ends to fold the corner flaps of the wrapper sheets. Finally, these end folds are held while bands are applied by the banding heads and secured transversely and longitudinally about the bale which is then ready to be removed from the press.

BRIEF DESCRIPTION OF THE DRAWINGS

In the accompanying drawings which illustrate the invention,

FIG. 6 is a schematic longitudinal sectional view showing the press parts in another operative position.

FIG. 6A is a detail vertical section taken on line 6A—6A of FIG. 6.

FIGS. 7, 8, 9, and 10 are schematic operative transverse sectional views showing the parts in still other operating positions.

FIG. 11 is a schematic isometric view showing the vertical folding fingers or rods advanced to their folding positions.

DESCRIPTION OF A PREFERRED EMBODIMENT

Figures 1, 1A:
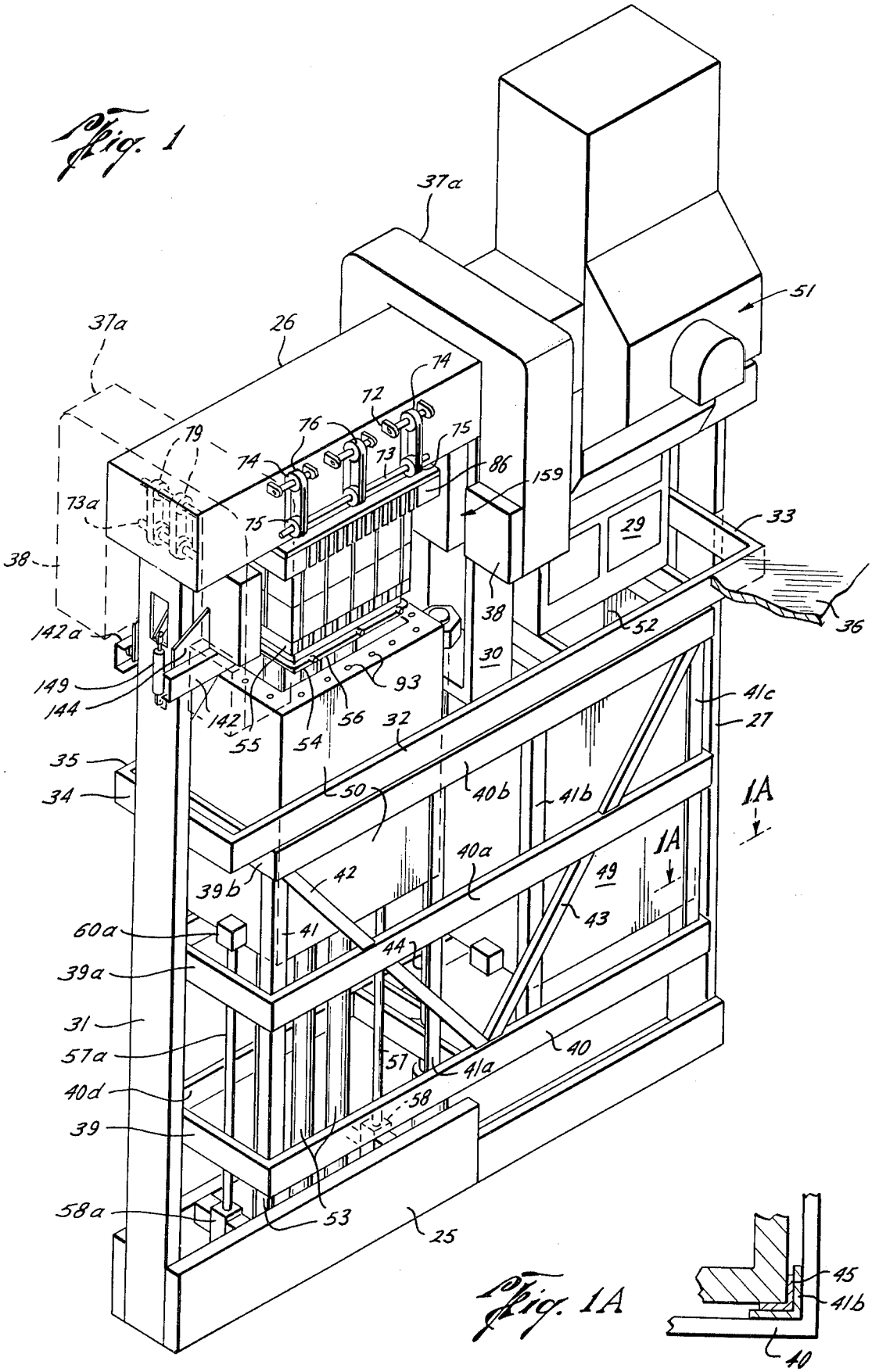
FIG. 1 is an isometric view of the press and indexing strapping frame and boxes, including the associated tramper after pressing, wrapping, and banding of a bale, the wrapper supply and support tables being omitted for clarity of illustration and the girth strapping-carriage being shown in its inner position for clarity.
FIG. 1A is a detail horizontal section taken on line 1A—1A of FIG. 1.
Figure 14:
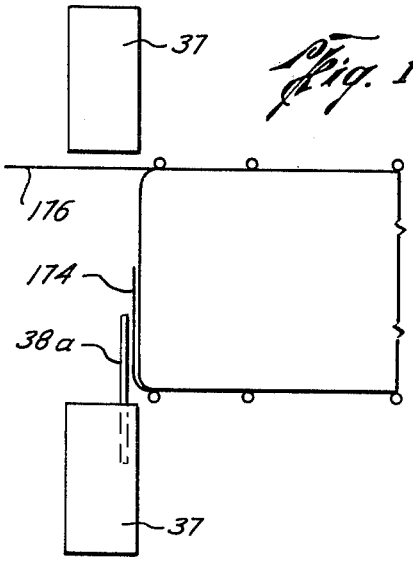
FIGS. 14, 15, 16, and 17 are schematic top views showing other operational positions of the folding and banding mechanism.
Figure 15:
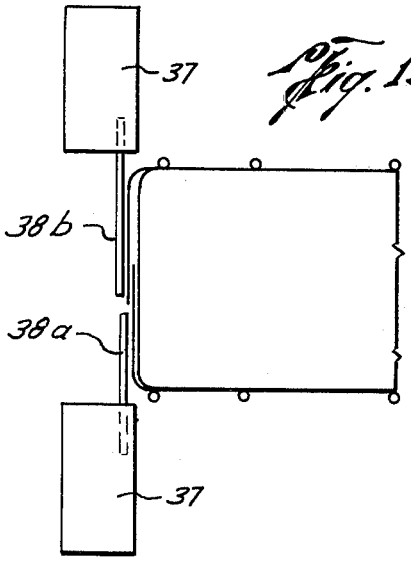
Figure 16:
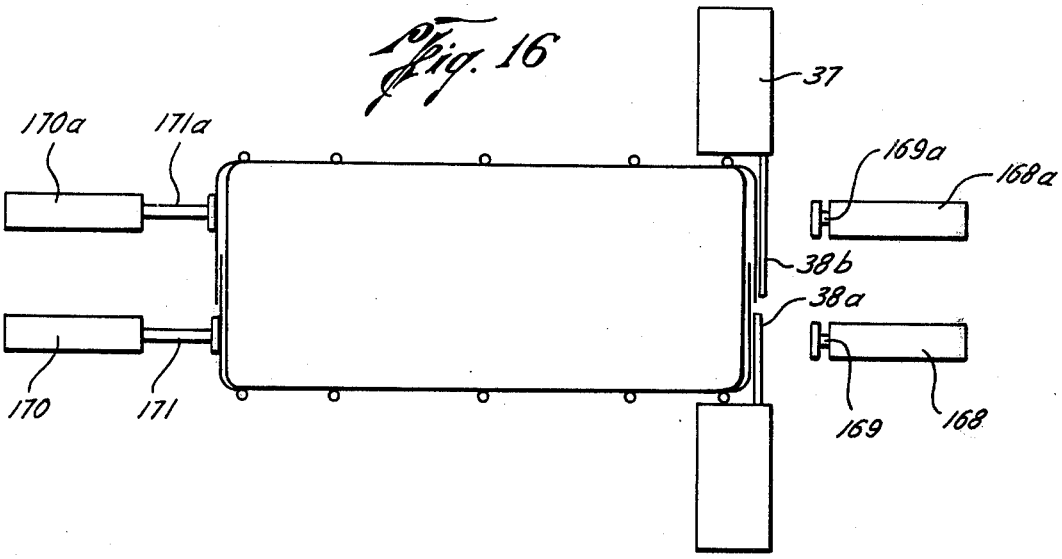

FIG. 1 shows a two-box press including vertically movable chambers 49 and 50, bottom and top sills 25 and 26, vertical end framing member 27 beneath tramper hopper 29, and more rugged vertical framing members 30 and 31 at the center and at the opposite end on the press side, respectively. Horizontal framing at 32, 33, 34, and 35 serves to support flooring 36. Indexing girth strapping mechanism is mounted in the inverted U-shaped housing 37 which traverses and rides along top sill 26. Mechanism 37 is shown in FIG. 1 in its inner extreme position for clarity, although its "home" position, after completion of the girth banding, is at the outer end as at 37*a*. Mounted on each leg of the frame 37 is a housing 38 for wrapper folding slide parts, 38*a* and 38*b* (FIGS. 14–16).

The rotatable double box frame includes horizontal end members 39, 39*a*, and 39*b* and horizontal front members 40, 40*a*, and 40*b*, vertical corner posts 41 – 41*e*, and other reinforcing and bracing members, and diagonals 42 and 43. This frame is pivotally mounted on a rugged centerpost 44 and its top is located just beneath flooring 36 which has an aperture or window 48 (FIGS. 2 and 6) shaped to permit the free passage vertically therethrough of the one of the pairs of press boxes 49 and 50 which is aligned therewith, as will be explained. Boxes 49 and 50 are doorless in the sense that they do not have the usual side doors and slide within stabilizing guide bearings in cornerposts 41, 41*a*, etc., as shown at 45 in FIG. 1A. Tramper hopper 29, beneath tramper 51, is also aligned with an opening or window 52 in the flooring for permitting charging of the box 49 or 50 aligned therewith and tramping of the fiber in the box to the proper weight or density. The rotating frame will be provided with suitable automatic, semi-automatic, or manual driving, latching, position sensing, and other control instrumentalities known in the art and not shown herein.

Located beneath flooring 36 and centrally of press framing parts 30 and 31 and centerpost 44 are hydraulic cylinders (not shown) which operate main rams 53 carrying at their upper extremities a follow block 54 including transversely extending platens 55. An air jet pipe 56 (FIGS. 1 and 3 – 9) surrounds the follow block 54 for a purpose to be described. FIG. 6 shows one of the press boxes 50 partially elevated by means of plungers 57 and 57*a* (FIGS. 1 and 6) operated by hydraulic cylinders 58 and 58*a*. The enlarged heads 59 and 59*a* of the plungers are seated in lug structures 60 and 60*a* at the bottom inner and outer edges of the box and are latched in position by latch means shown in FIG. 6A. This means comprises latch detents 62, 62*a* slidable in cylinders 63, 63*a* and normally urged by springs 64, 64*a* into their latching positions beneath plunger heads 59, 59*a*. Levers 65, 65*a* have bearing rollers 66, 66*a* at their distal extremities for engaging fixed cam lugs 67, 67 *a* as the box approaches its lowermost position to retract the latch detents. Press boxes 49 and 50 are shown as being of plainwalled construction, but may be provided with suitable reinforcing ribbing and other features, not part of the present invention.

Along the top portions of the press box walls (FIG. 1) are provided small, vertically oriented cylinders 93 from which project (FIG. 11) the lower folding fingers 68 (front and back), and 69 (end), the former having smooth bulbous extremities, as at 68*a*, for engaging and folding the lower wrapper sheet, as will be explained. End fingers 69 are made of flat straps. The groups of fingers mounted in each box wall may be joined, as by a bar 70 (FIG. 13), and reciprocated by a single motor, as at 71. The cylinder of motor 71 is supported at the top by a bar 71*a* and receives a piston from which folding finger 68*b* projects upwardly. At the bottom of each box are provided bottom panels 81 (FIGS. 3 – 5) mounted on pivoting shafts 82 journalled in the box front and back walls. The shafts are operated from hydraulic motors 83 by means of levers 85 rigid with the shafts. Suitable controls (not shown) will be provided for the door shafts 82. The boxes are provided with more or less conventional dogs 187 with controlling hydraulic cylinders 188 and levers 189.

Figure 13:
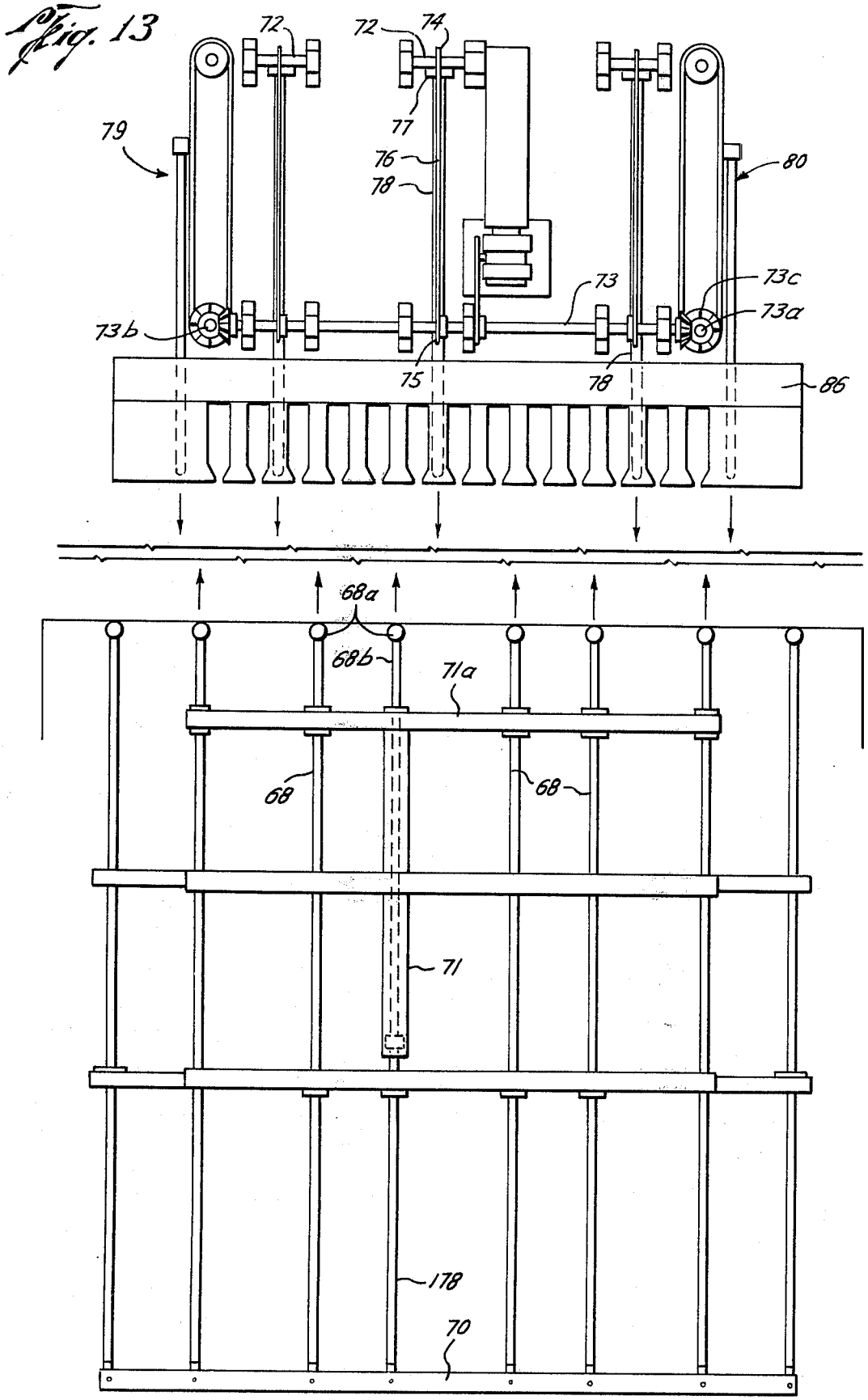
FIG. 13 is a schematic front view of a part of the press showing the upper and lower folding fingers, parts being omitted for clarity.

Mounted in suitable bearings on the front and rear sides of massive upper sill 26 (FIGS. 1 and 13) are stub shafts 72 and through shafts 73 carrying sprockets 74 and 75, each vertical pair of sprockets receiving a chain 76 in meshed relationship. Each chain is provided with a lug 77 to which is rigidly secured a depending upper folding finger 78. Corresponding end finger actuating mechanisms, inside the upper sill, are shown in FIGS. 1 and 13 at 79, 80. Lower front and back sprocket shafts 73 are connected to end sprocket shafts, as 73*a*, 73*b* by bevel gears, as at 73*c* (FIG. 13), and any one of these shafts may be powered to cause simultaneous lowering and lifting of all the upper fingers.

Mounted on the undersurface of massive upper sill 26 is the top platen structure 86. As shown in FIGS. 8 – 10, an air jet pipe 87 is mounted on the top platen structure for applying air jets through depending nozzles 87*a* against the upper wrapper sheet, as will be explained.

Figures 2, 2A:
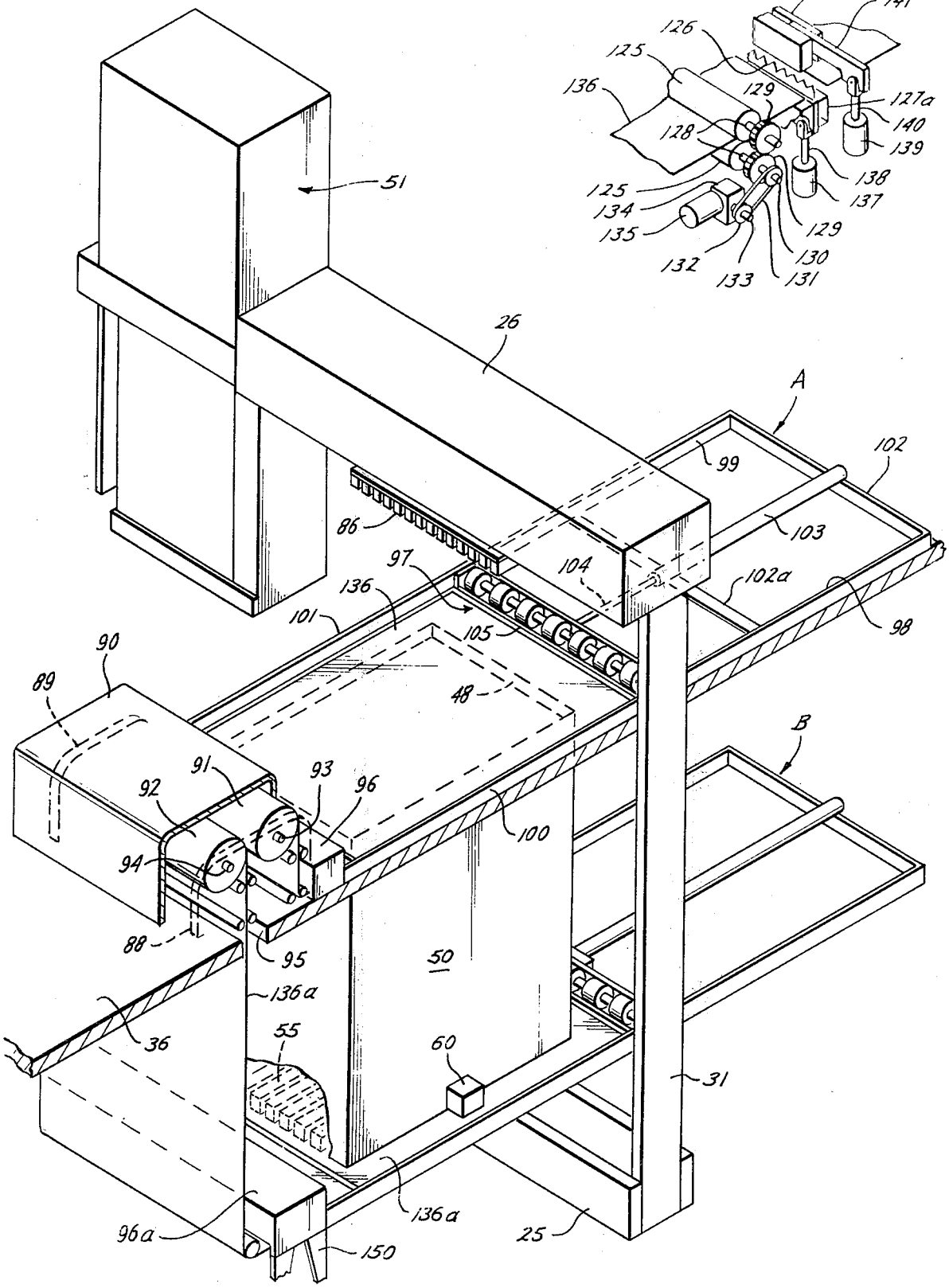
FIG. 2 is an isometric view showing stationary framing parts of the press with the wrapper supply and support trays applied thereto.
FIG. 2A is an enlarged isometric view of the wrapper severing mechanism.

FIG. 2 shows the mechanisms for delivering the wrapping material transversely through the stationary framing and between a press box in the press position and the top and bottom platens. These mechanisms are omitted from FIG. 1 for clarity. Resting on the floor 36 leftwardly of window 48 therein and between a pair of upstanding bracket-walls 88 and 89, shown dotted, is a housing 90 for a pair of wrapping material supply rolls 91 and 92 on shafts 93 and 94 journalled in housing end walls 88 and 89. The material from roll 92 is guided through a slot 95 in the floor. Also resting on the floor, between housing 90 and window 48, is a second housing 96 for the wrapper material clamping and cutter mechanism, illustrated in FIG. 2A. Rightwardly of window 48, shown in its retracted position, is the mobile wrapper gripping carriage, generally designated 97, which may be moved along tracks 98 and 99 on the inner surfaces of opposed side frame members 100 and 101 connected at their opposite ends by housing 96 and end member 102. Members 100, 101, and 102 and housing 96 form the upper skeleton table A resting on floor 36. Another similar table B is mounted on legs, as 150, just above bottom sill 25 and bottom platen structure 55.

The mobile carrier 97 is actuated by a pneumatic motor, including a cylinder 103, supported at its outer end on end member 102 and at its inner end on cross member 102*a*. The piston rod 104 (FIG. 2B) projects from cylinder 103 to the mobile carriage 97. As illustrated in more detail in FIG. 2B, the mobile carriage includes a transverse angle bar member 105 including vertical and horizontal flanges 105*a* and 105*b* from the ends of which parallel legs 106 and 107 project toward end member 102. V-track rollers 109, 109*a* and 110, 110*a* are mounted on the outer sides of the legs 106, 107 for running in tracks 98, 99 formed by the bottom flanges of frame channels 100 and 101. An air cylinder 111 (FIGS. 2B and 2C) is secured to the inner face of leg 107 and encloses a double-acting piston 111*a* from which project in opposite directions piston rods 112 and 113 connected to the ends of chains 114 and 115 which encompass and mesh with sprockets 116 and 117 on stub shafts 118 and 119 journalled in leg 107. The other ends of chains 114 and 115 are connected to an oppositely threaded tightening nut 120.

Sprocket 117 is keyed to stub shaft 119, at its inner end, which is eccentrically secured to, or rigid with, a gripping cam shaft 121 upon which are applied at intervals therealong sleeves 122 of rubber or other gripping material. A stub shaft 123 projects eccentrically from the opposite end of cam shaft 121 and is journalled in opposite longitudinal leg 106. Sleeves 122 are of such size and positioning as to grip the edge of a sheet of wrapping material interposed between the same and bottom flange 105*b* of transverse plate angle bar 105, when shaft 121 is rotated. Shaft 121 is rotated in the gripping and releasing directions by means of air motor and connections 111, 112, 113, etc.

Within the intermediate housing 96 there are provided (FIG. 2A) a pair of wrapper sheet feed rollers 125, the toothed cutter blade 126 guided between stationary bars 127*a*, and the movable gripper bars 127 cooperable therewith. Rollers 125 are mounted on drive shafts 128 carrying meshing gears 129. Lower shaft 128 also carries a drive member, for instance, a sprocket 130, connected by a chain 131 and sprocket 132 to the drive shaft 133 projecting from a gear box 134 and motor 135. Rollers 125 are positioned so as to grippingly receive therebetween a sheet 136 of wrapping material supplied from roll 91. The lower wrapper sheet is designated 136*a*.

Toothed blade 126 (FIG. 2A) is actuated by a pair of fluid-operated motors, one being shown at 137 connected to the cutter blade by a clevis rod 138. Gripping bars 127 are actuated by a pair of fluid-operated motors, one being shown at 139 connected to the gripper bars by means of a clevis rod as 140 and an extension plate 141. The wrapper clamping and cutting mechanism is duplicated at 962 on lower table B.

Figure 12:
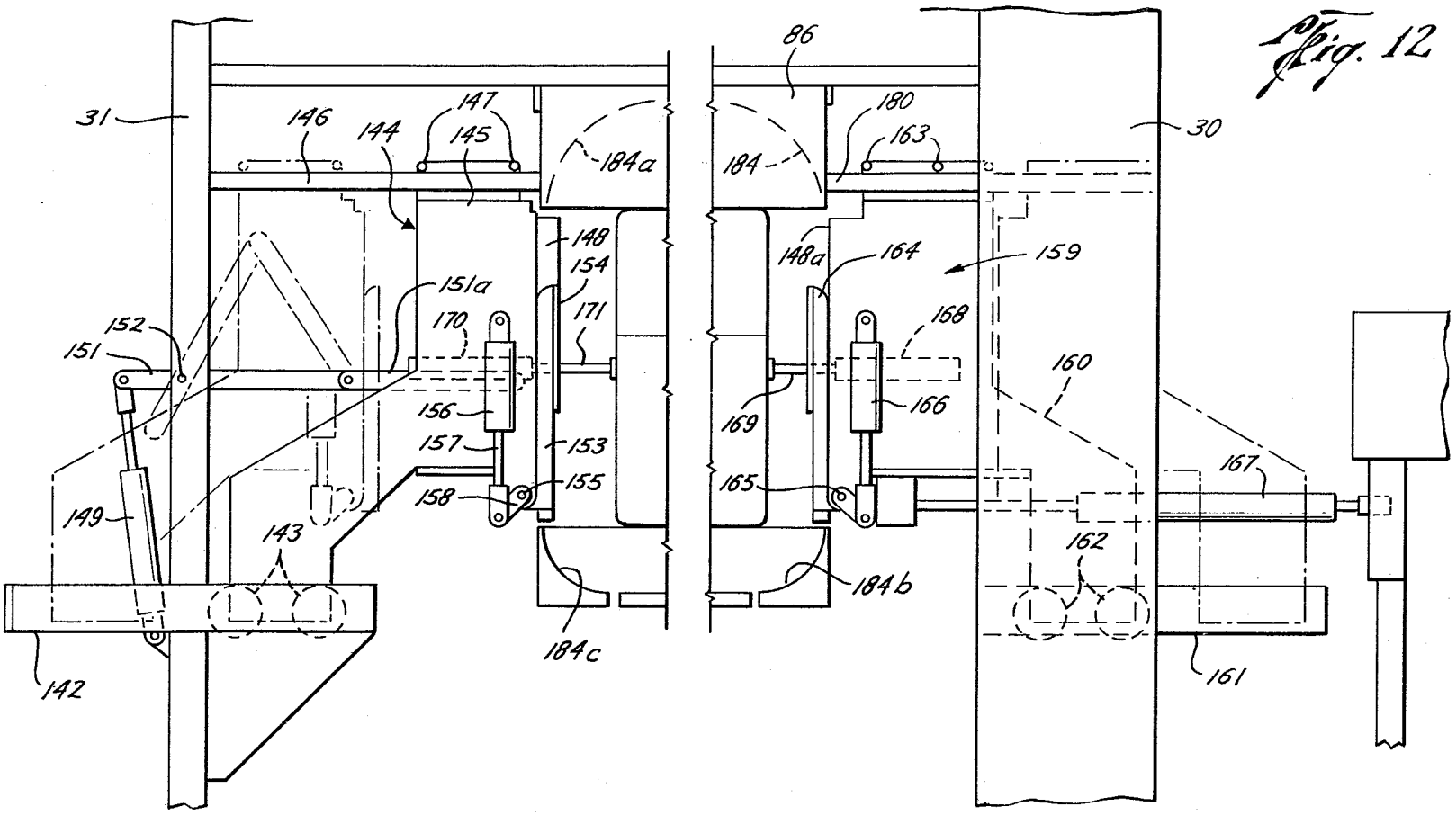
FIG. 12 is a front view of the press, particularly illustrating the end flap holding and longitudinal strapping parts.

FIG. 12 and 13 show several operational folding and banding parts omitted from previous figures for clarity. The outer end banding carriage 144 (FIG. 12) comprises a body 145 movably carried on tracks 142 by means of rollers 143 and from the top support structure 146 by means of rollers 147. Body 145 carries end and corner banding track parts 148, 148*a*, and 184–184*c* and is actuated to and from banding positions by means of an air motor 149 and links 151 and 151*a*, the former being pivoted at 152 on stationary frame upright beam 31 and the latter being pinned to body 145. The arrangement is such that when motor 149 breaks linkage 151, 151*a*, as indicated in dot and dash lines, body 145 is retracted, and vice versa. Also pivotally carried on carriage 145 are a pair of hold down feet 153 having face pads 154 of yielding or gripping material. The feet are mounted on a pivot shaft 155 which may be rotated, to swing the feet as will be described, by means of an air motor 156 through piston rod 157 and crank 158.

At the inner end of the bale (FIG. 12), adjacent center post structure 30, is the inner banding head, generally designated at 159. This head includes a body portion 160 carrying the longitudinal band driving, securing, and tightening mechanisms (not shown). Body 160 is supported from tracks 161 on rollers 162 and from the top support plate 180 by means of small rollers 163. A pair of hold down feet 164 are pivotally mounted on body 160 by means of pivoting shaft 165 and are operated by means of an air motor 166. Body 160 may be advanced and retracted by means of an air motor 167. Also carried by body 160 is an air motor 168 which actuates a wrapper flap holding finger 169, the function of which will be described. Parts 168 and 169 correspond to motor 170 and holding finger 171 carried by outer banding body 145. Preferably, a pair of the flap holding fingers 169 and 171 will be provided at each end of the bale.

FIG. 13 illustrates in greater detal the front lower wrapping folding fingers 68, 68*b* and end lower wrapper fingers 69 which project from hollow front, rear, and end walls of each press box and are connected at their bottoms by a bar 70. Bar 70 is medially connected by a rod 178 to the piston of a fluid motor 71 for actuating the group of folding fingers 68, 68*b* together. As previously mentioned each group of folding fingers may be similarly actuated in unison.

Figure 18:
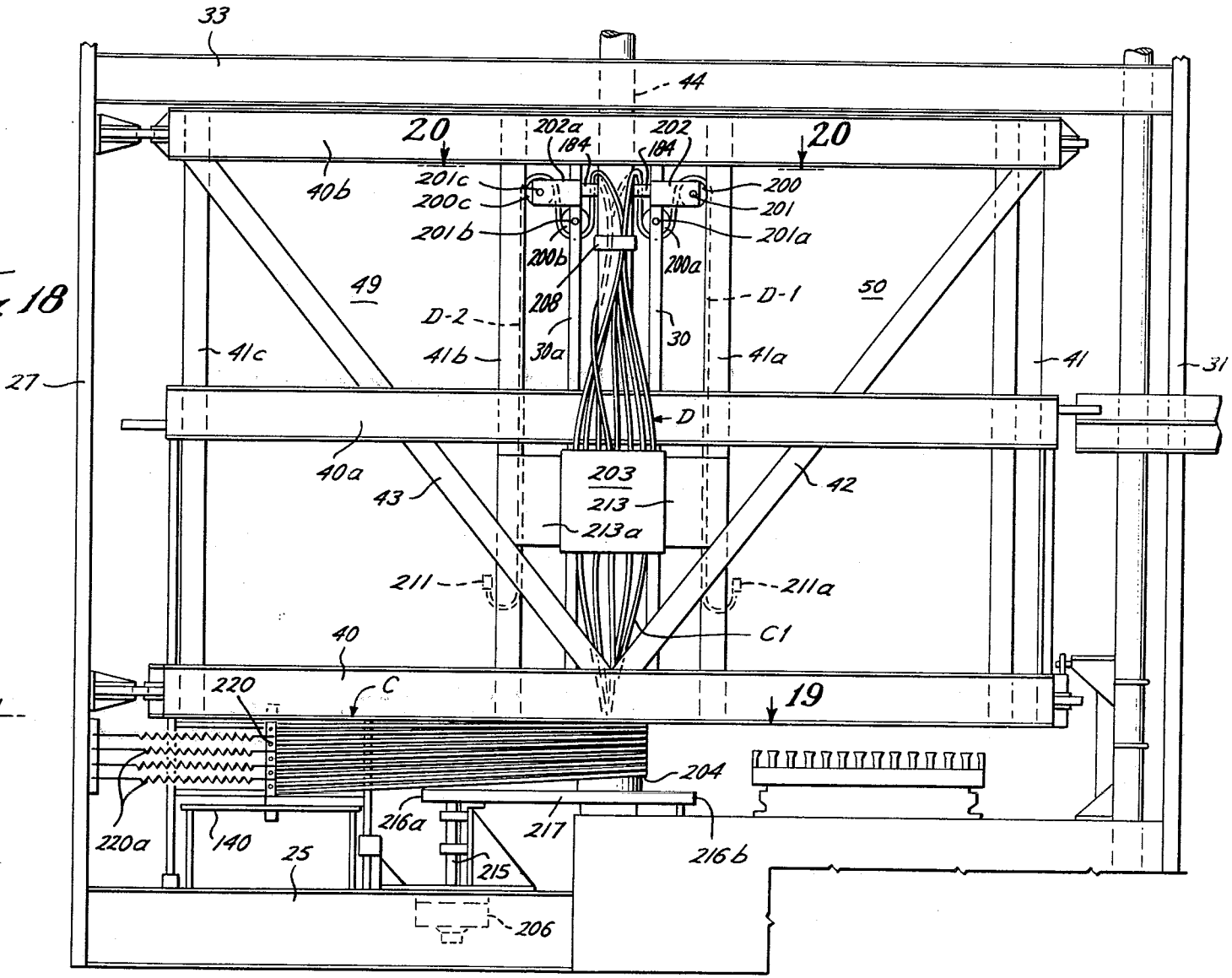
FIG. 18 is a rear elevation of the stationary and rotating framing illustrating particularly the conduits connecting electrical and hydraulic power sources to operated devices on the movable boxes.
Figure 19:
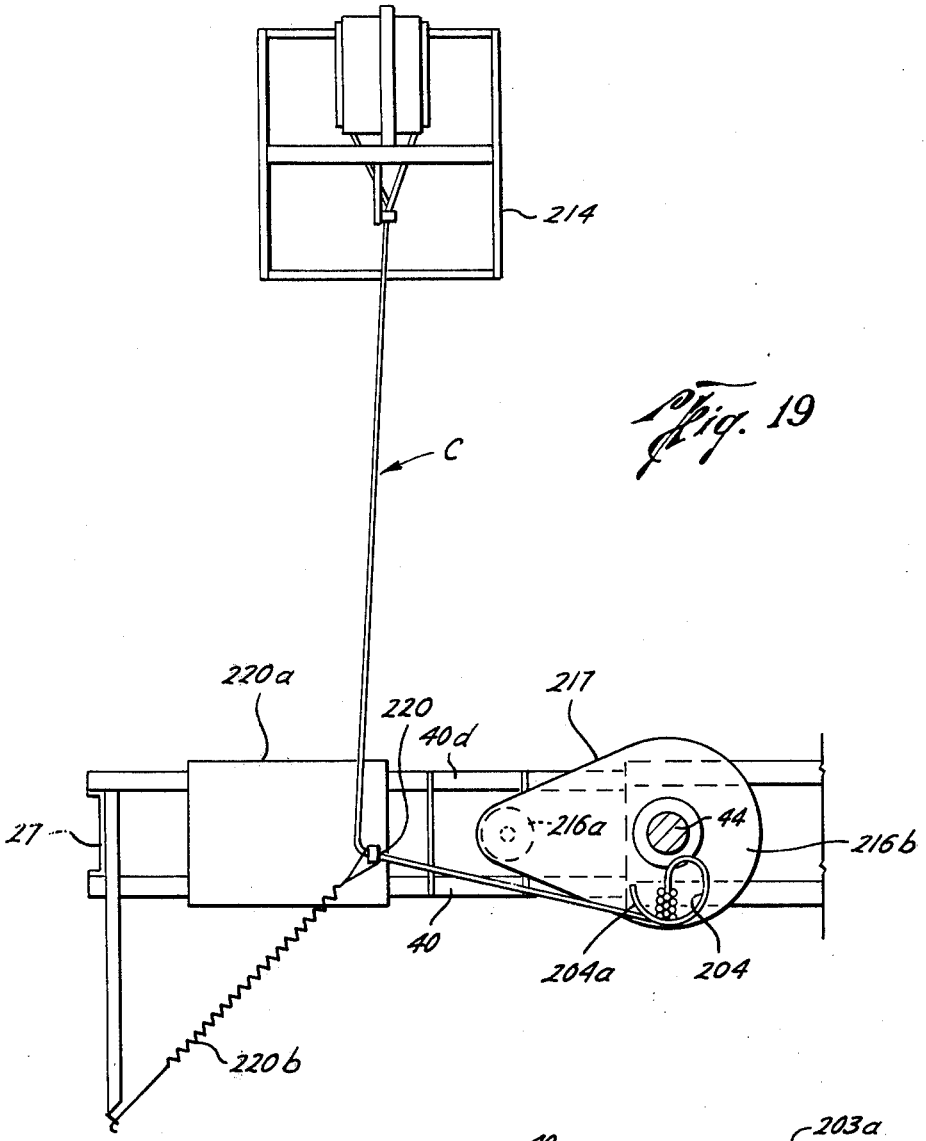
FIG. 19 is a half horizontal section taken on line 19—19 of FIG. 18.
Figure 20:
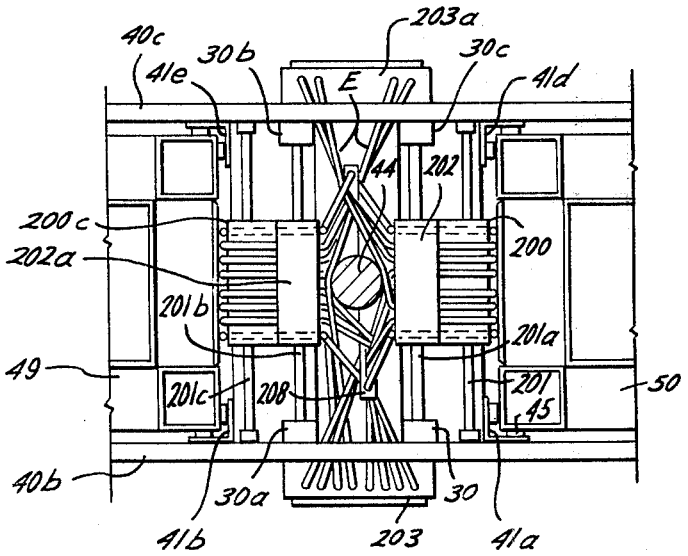
FIG. 20 is a partial horizontal section taken on line 20—20 of FIG. 18.

FIGS. 18, 19, 20, and 21 illustrate the special means for connecting the power sources with the various control motors, switches and sensors which are mounted on and move with the press boxes 49 and 50. Pairs of inner, vertical channel posts 30, 30*a*, 30*b*, and 30*c* on opposite sides of center pivot post 44 extend between bottom and top rotating frame members 40 and 40*b* and 40*d* and 40*c*. (These channel posts are omitted in FIG. 21 for clarity). Drums 200, 200*a*, 200*b*, and 200*c*, are rotatably mounted on horizontal axles, 201, 201*a*, 201*b*, and 201*c* secured between the pairs of channels 30, 30*c* and 30*a*, 30*b* and brackets 202, 202*a*. A pair of multiple junction boxes 203, 203*a* are mounted on brackets as 213, 213*a* connecting the inner box guide corner posts. Rigid with rotating frame bottom member 40 and directly rearward of pivot post 44, there is a half cylinder guide member 204 with a spiral extension 204*a*. The energising and control console is shown at 214 in FIG. 19. Also shown in FIG. 18 is the box turning mechanism, including electric motor 206, drive shaft 215, sprockets 216*a* and 216*b*, and drive chain 217.

Figure 21:
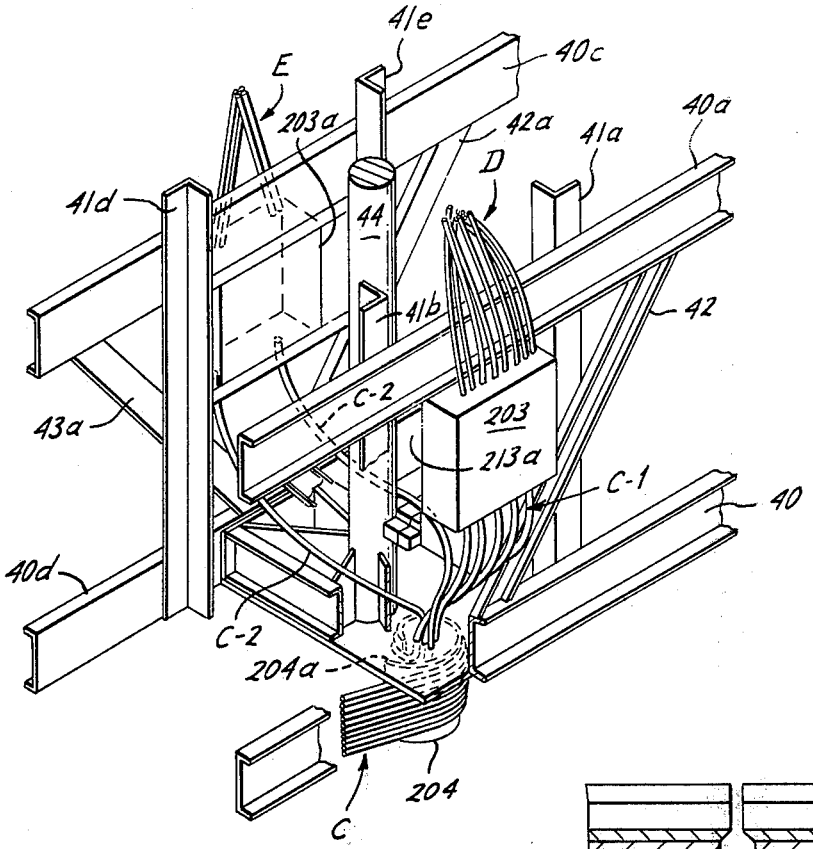
FIG. 21 is an isometric view of a part of the structure in FIG. 18.

For energizing and controlling various devices, switches and valves mounted on the box, including latches 187, bottom door or panels 18, and lower folding fingers 68, a bundle C of ten flexible conduits, some being pressured fluid hoses and others electrical cables, arranged in a vertical plane, extends from console 214 through and is secured to a vertical cleat device 220 on a support 220*a* and restrained by tension springs 220*b*. The conduits thence make substantially a right angle, and pass around corresponding annular grooves in spiral guide member 204, 204*a*, then are guided axially through this member, as best shown in FIG. 21. Eight of these conduits then pass upwardly to junction box 203, as at C-1. The other two conduits pass across the frame, as at C-2, then upwardly to front junction box 203*a*. From boxes 203, 203*a* other bundles D and E of flexible conduits continue upwardly through a first pair of aligning guides 208, then turn downwardly through a second set of aligning guides 210 (FIG. 18), then pass in order, around the circumferentially grooved guide drums 200*a* and 200*b* and 200 and 200*c*. Finally, all of the conduits drop, as at D-1 and D-2, and are connected by terminals 211 and 211*a* to the vertically slidable press boxes. Other lines (not shown) connect terminal fittings 211, 211*a* to the various fluid and electric motors and controls which move with the boxes, for instance, the motors for the front, back, and end lower fingers 68, 69, etc., for box dogs 182 and for bottom panels 81.

Figure 22:
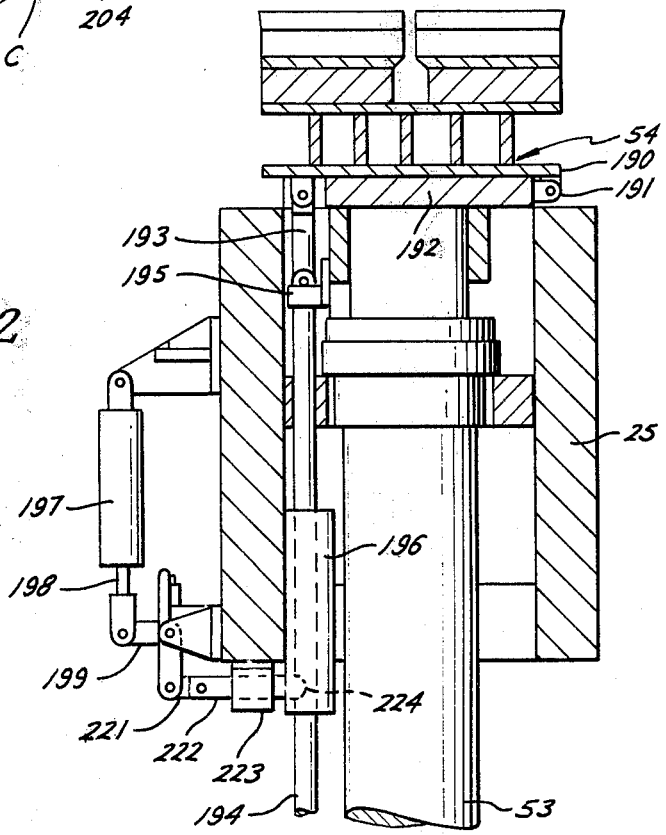
FIG. 22 is a vertical transverse central section through the rams and illustrating the bale ejection parts.

FIG. 22 shows in transverse section the bale eject brake mechanism. Follow block 54 rests on a shelf 190 having a pivotal attachment 191 to the cap plate 192 of the press rams 53. A link 193 is pinned to the opposite edge of shelf 190 and, at its lower end, is pinned to a push rod 194 vertically slidable in guides 195 and 196. A fluid cylinder 197 mounted on the side of press bottom sill 25 is connected by piston rod 198, bell crank 199, and link 221 to a latch detent 222 slidable in a guide block 223. At a predetermined point near the bottom of the ram movement, cylinder 197 will be energized through a limit switch and solenoid (not shown) to shift the detent into a latching slot 224 in push rod 194, stopping descent thereof. Continued lowering of the rams tilts shelf 190 and the follow block to eject the bale.

OPERATION

Figure 2B:
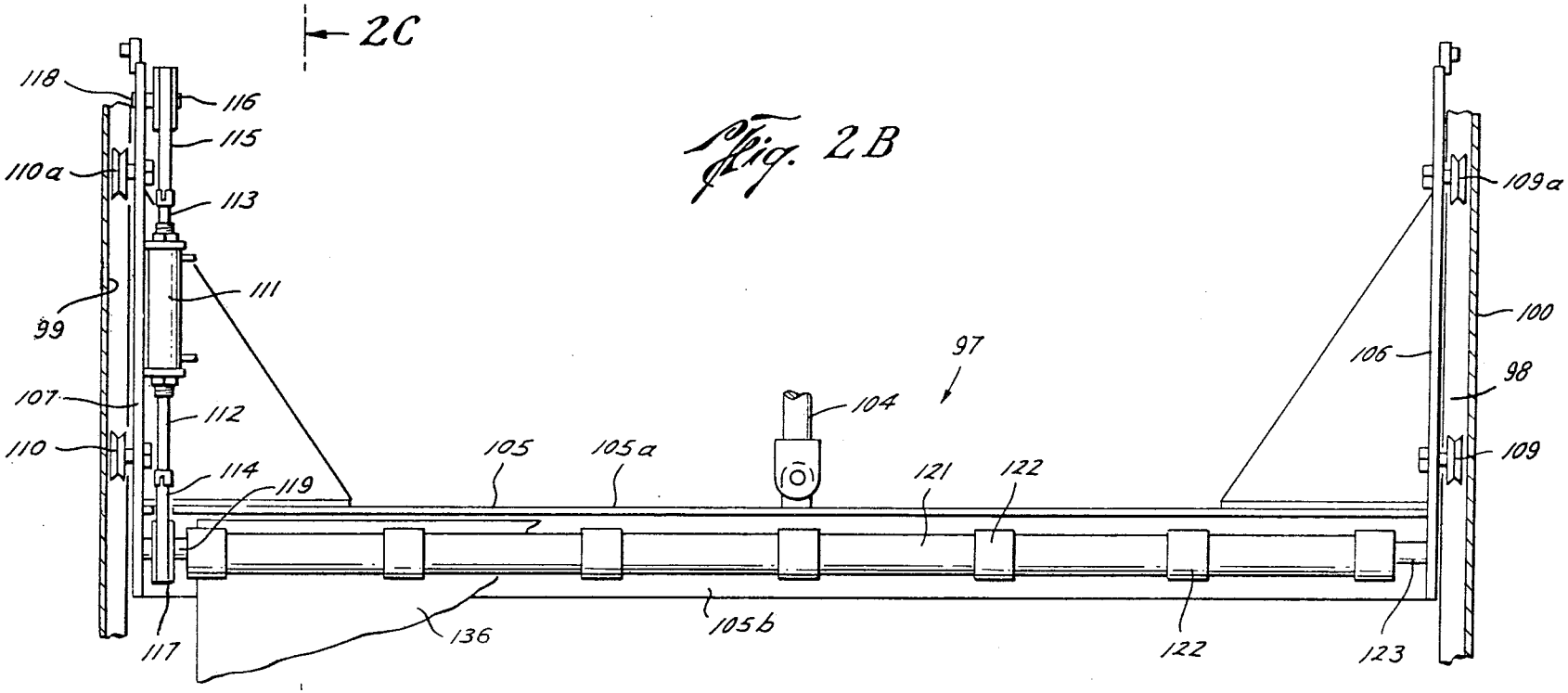
FIG. 2B is an enlarged plan of the mobile carriage that stretches and positions unsevered wrapping material taken from the supply roll.
Figure 2C:
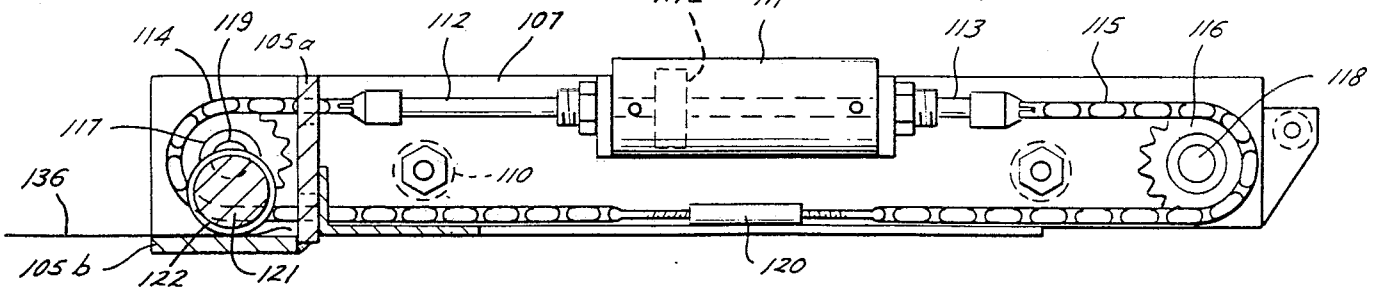
FIG. 2C is a section taken on line 2C—2C of FIG. 2B.

With main rams 53 and the follow block 54 fully lowered, the box of tramped fibers is turned to its press position above the follow block (FIG. 3) and, at the same time, the feed of wrapper material is automatically initiated to draw upper sheets on tables A and B across the upper and lower platens. The arrangements of the feeds for the upper and lower sheets are identical and their operations simultaneous; the functioning of the upper of these feed parts in connection with forming the wrapping and tying of the bale will be described serially. During rotation of the boxes, each mobile carriage 97 (FIG. 2) advances toward its wrapper feed rollers 125 which are actuated to feed about 6 inches of the wrapper material 136, 136*a* to a position beyond the clamp parts 127, 127*a* and blade 126 and between rubber sleeves 122 and clamp bar flange 105*b* (FIGS. 2B, 2C). The rollers 21 are then rotated to grip the edges of the material 136, 136*a* after which the mobile carriages 97 are retracted to the positions of FIG. 2 to draw the proper quantities of material from the supply rolls 91 and 92. Movable clamp bars 127 are then drawn downwardly to clamp the material against bars 127*a*, and the toothed knife blade 126 is elevated to sever the material. As indicated, both upper and lower cover sheets will be fed and severed at the same time and in the same manner.

PRESS CYCLE

Figure 5:
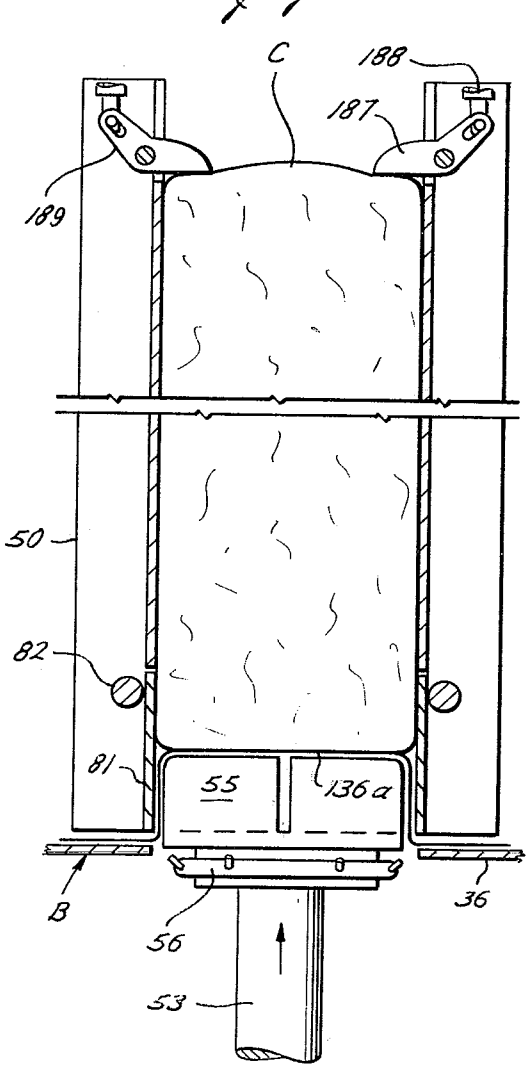
FIGS. 3, 4, and 5 are schematic transverse sectional views showing a press box, fiber, follow block, bottom panels, and a portion of the wrapper applying mechanism in three successive operational positions.
Figure 4:
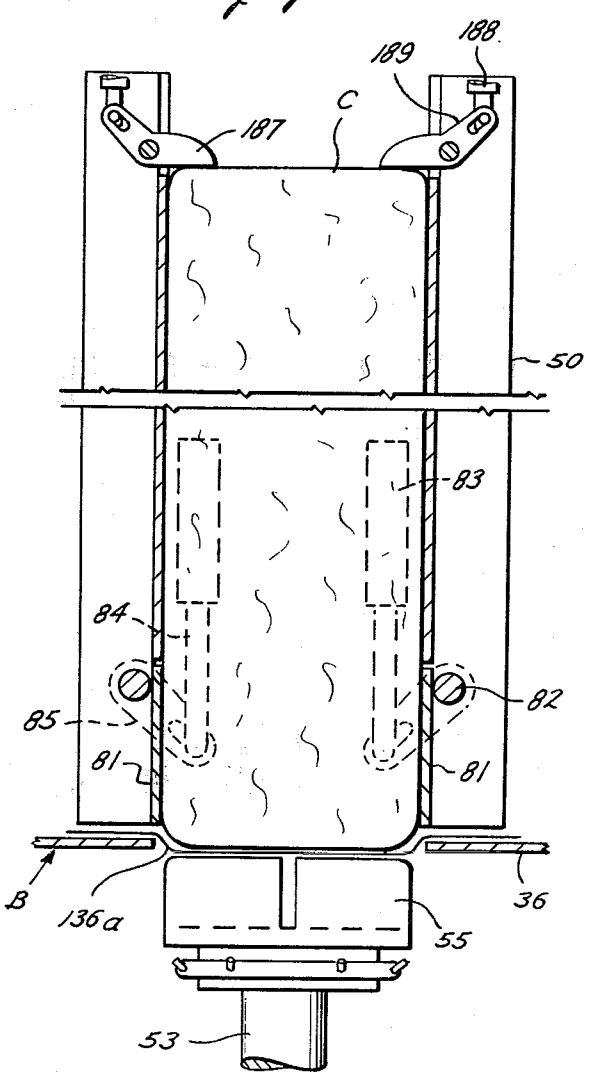
Figure 3:
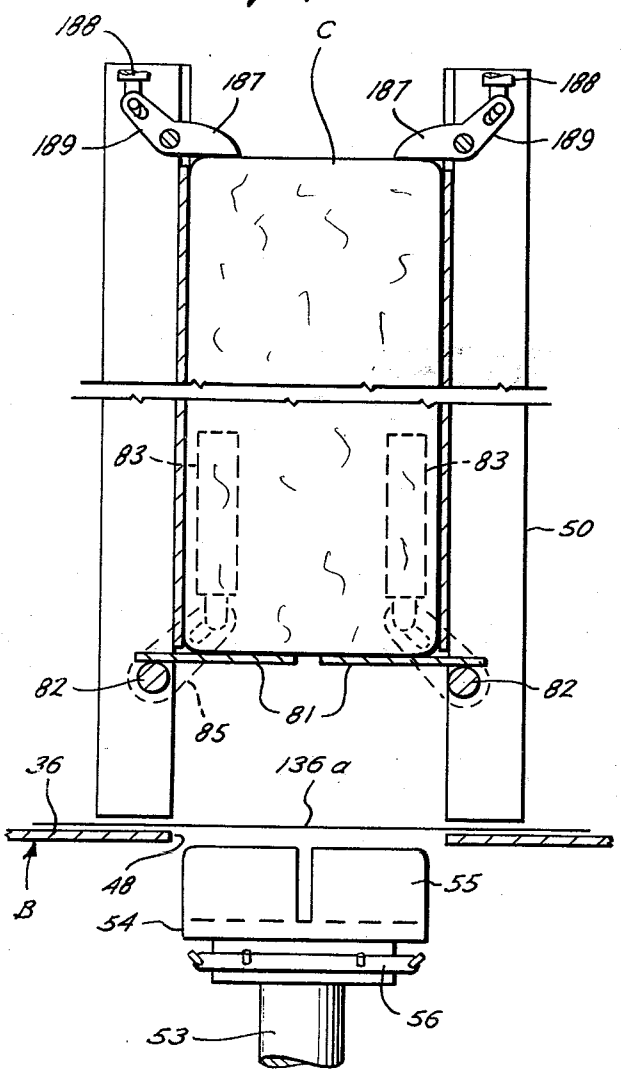

With the parts in the position of FIG. 3, the bottom panels 81 of the press box are closed and dogs 182 are in their extended holding positions. The dogs are actuated by conventional fluid motors and linkages schematically represented at 189, 188 and mounted on the box. The follow block 54 is positioned closely beneath lower wrapper 136*a*. In FIG. 4, the bottom panels 81 have been fully opened to drop the tramped charge C and the severed bottom cover sheet 136*a*, released from clamps 127, 127*a* upon follow block platens 55. In FIG. 5, the follow block has been moved upwardly so as to engage the severed bottom cover sheet and draw it upwardly within the bottom of the press box. In this position, a photocell device (not shown) signals that the sheet has been properly cut off and is being drawn upwardly by the follow block. In the absence of this signal, indicating, for instance, that the sheet has not been cut, the machinery is stopped.

After a brief pause, the press box stripping plungers 57, 57*a* are elevated to engage seat lugs 60 60*a* at the bottom of the box (FIG. 6). The plungers are latched in seats 60, 60*a* (FIG. 6A) as rollers 66, 66*a* pass above cam lugs 67, 67*a*. The follow block and box are then elevated together to cause the top of the box to pick up the cut top cover sheet 136 and move it abreast of top platen 86. The upper sheet 136 will be held by its clamps 127, 127*a* (FIG. 2A) and 105*b* and 121 (FIG. 2B) until approached by the box, whereupon sheet 136 will be severed and released. During this joint upward movement of the follow block and packer box, in case excessive pressure is applied to the dogs 189, the resultant increase of pressure in the dog-controlling hydraulic motors 188 by means of suitable fluid connections and valving (not shown), has the compensating effect of diverting flow of hydraulic fluid from the main ram system to the box elevating hydraulic system so as to restore the desired box and follow block relationship.

As the box approaches the upper platen, the box dog motors 188 are actuated by hydraulic interconnection with the box elevating and ram cylinders (also now shown) to open dogs 187 releasing the charge C to force the upper severed wrapper sheet 136 against the top platen 86 (FIG. 6). The elevation of the box now ceases, but the main rams continue to drive the follow block into the box compacting the fibers to the proper density (FIG. 7).

WRAPPER FOLDING CYCLE

Next, the box 50 is drawn downwardly by its stripping plungers 57, 57*a* (FIG. 8) sufficiently to clear the bale and both of the cut wrapper sheets. With the free peripheral portions of the bottom sheet hanging, as illustrated in FIG. 8, the top front, back, and end folding rods 78, 78*a* are lowered, as in FIG. 10, to fold down the extending perimeters of the top sheet. Now air is jetted from nozzle pipes 56 on the follow block against the underside of bottom cover sheet 136*a* so as to blow the sheet away from the follow block. Other means may be utilized for elevating the perimeters of the lower cut sheet. Then, as shown in FIG. 9, the box is elevated sufficiently to support the free perimeters of the bottom wrapper sheet so as to lie flat approximately in the plane of the bottom of the bale. FIG. 10 also shows the outer hold-down feet 153 lowered against the projecting bottom end flap, the inner hold-down feet 164 (FIG. 12) being lowered at the same time.

Following this, air jets from upper nozzles 87*a* discharge against the free parts of the upper wrapper sheet (FIG. 9) to cause the same to cling to the bale surface, while the bottom front and back fingers 68 are elevated to fold the front and back extension flaps of the bottom sheet against the bale and overlapping in part the upper folds. The upper and lower folding fingers are staggered, as shown in FIG. 11, to permit such overlapping. This leaves corner flaps or protrusions, as at 173, 173*a*, and 175 in the lower sheet and similar corner flaps or protrusions 174, 174*a*, and 176 in the top sheet. Next, outer and inner hold-down feet 153 and 164 are retracted. Thereupon, lower end fingers 69 at the outer end and the corresponding fingers at the inner end (not shown) are raised to make the end folds between flaps 173–176.

In order to horizontally fold corner flaps 173–176 the indexing strapping frame 37 is now moved from its home position 37*a* (dot-dash lines in FIG. 1) inwardly to a position abreast the outer end of the bale, as in FIG. 14. One flap folding slide 38*a* is now projected to fold the corresponding No. 1 lower and upper corner flaps 173, 174 inwardly against the outer end of the bale. Next, as shown in FIG. 15, slide 38*a* is withdrawn slightly, and opposite slide 38*b* is advanced to fold the opposite corner flaps 175, 176 (FIG. 11) inwardly against the outer end of the bale with their extremities slightly overlapping flaps 173, 174. Now, air motor 149

(FIG. 12) is actuated to move outer end banding carriage 144 toward the bale, and air cylinders 170, 170*a* (FIGS. 12 and 16) are also energized to advance rubber-tipped fingers 171, 171*a* against the overlapped end flaps for holding the same in position. Slides 38*a* and 38*b* are now retracted.

Next, the indexing strapping frame 137 is moved to the inner end of the bale, as in FIG. 1, solid lines, and slides 38*a* and 38*b* are again actuated sequentially to horizontally fold the end flaps 173*a*, 174*a* (FIG. 11) and the opposite inner end flaps against the inner end of the bale. The inner banding head 159 is then moved toward the bale by means of its air motor 167, and air motors 168, 168*a* are energized to advance rubber-tipped fingers 169, 169*a* against the folds, permitting retraction of folding slides 38*a*, 38*b* completing the folding operation.

Figure 17:
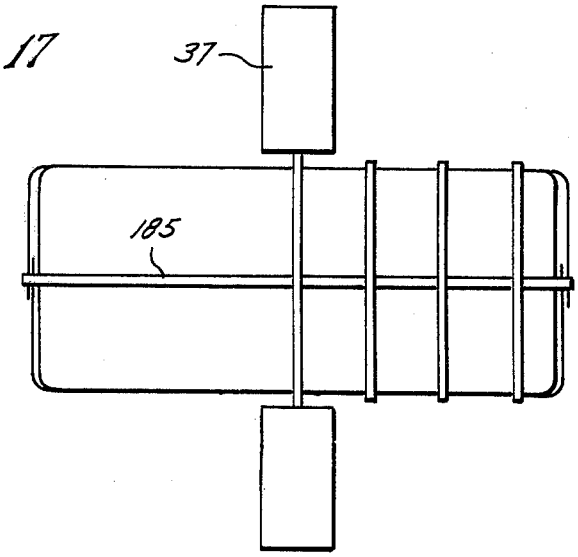

Upon completion of the folding steps, the end folding slides and the front, back, and end folding fingers, as well as the hold-down feet and end flap holding fingers, are fully retracted. With all longitudinal guide tracks, including corner portions 184, 184*a*, 184*b*, and 184*c*, in banding position, banding head 159 is actuated to drive the longitudinal band 185 around the bale. While the longitudinal band is tensionally held by the banding head, but not sealed, carriage 37 is indexed outwardly along the bale to apply and seal the girth bands 186 (FIG. 17). When carriage 37 reaches its home position (37*a*, FIG. 1), the longitudinal band is sealed and released and the follow block is lowered. As previously explained, as the follow block completes its downward travel, a limit switch is actuated to cause locking of eject push rod 194 (FIG. 22) so that the follow block is tilted to eject the bale. The follow block is then raised sufficiently to recontact the limit switch and unlock the eject rod. The ram and follow block are then fully lowered, ready for rotation of the double boxes to bring a new tramped charge into press and wrapping position. Throughout all movements of the press boxes, the hydraulic and electrical connections for powering the various box functions are fed smoothly and without interference.

Various programming means may be utilized embodying, for instance, limit switches which sense the completion of one operation or step to energize, as through solenoids and other switches, powering means for effecting succeeding operations. It is also contemplated that various failure and safety features will be built into the control systems. Alternately the various steps, as described, may be operated semi-automatically, relying, for instance, upon manual actuations at the particular stages to continue the steps according to a prearranged sequence. It is also contemplated that the machine may be operated entirely manually, for instance, for checking the various steps. Various features of the press itself may be altered according to known arrangements, as can the particular banding means used, these features, in themselves, not constituting the present invention. However, we believe that we are the first to provide for fully automatic wrapping of bales while still in the press, thus greatly increasing the speed of formation of the neatly wrapped bales and reducing the cost thereof, particularly, the labor factor. We have found that the impervious synthetic sheet wrapping material sold by E. I. du Pont de Nemours & Co. under the trademark Typar has worked very well for the purpose, but, of course, our apparatus will function with any suitable wrapping material.

The invention may be modified in various respects as will occur to those skilled in the art, and the exclusive use of all modifications as come within the scope of the appended claims is contemplated.

We claim:

1. The combination with a baling press having charge compression means including opposed platens, of automatic bale wrapping means comprising powered mechanism for applying wrapping material across at least one of said platens prior to compression of a charge thereagainst, a press box normally positioned between and normally spaced from said platens to accommodate said mechanism, wrapper folding means movable along opposite faces of the compressed bale for applying said material to at least one of the faces of the bale, means for applying bale-securing elements about said applied wrapping material, and means for separating said box at least in part, from the bale to provide clearance for said wrapper folding means.

2. The combination described in claim 1 including mechanism for applying individual sheets of wrapping material to both of said platens and wrapper folding members movable oppositely along a plurality of the bale faces.

3. The combination described in claim 1 in which said box is axially slidable relative to said platens for clearing a bale compressed between said platens.

4. The combination described in claim 3 in which said wrapper folding members are at least in part mounted on said box for actuation along faces of the bale when said box has been shifted clear of the bale.

5. The combination described in claim 4 further including framing structure adjacent one of said platens, others of said wrapper folding members being mounted on said structure.

6. The combination described in claim 3 in which said press is of the double box type including a center support and a rigid frame pivotally mounted thereon, there being a pair of said boxes slidably mounted on said frame on opposite sides of said support.

7. The combination with a baling press having a press box and ram platens at the ends of said box, of a pair of tables between said box and platens and each having apertures registering with said box and platens, supplies of wrapping material adjacent said apertures, and means for feeding sheets of said material along said tables and across said apertures and for severing said sheets to provide bale wrappers between said platens and a charge in said box.

8. The combination described in claim 7 further including means for sliding said box endwise relative to said platens, for clearing opposed faces of a bale compressed against said platens, and wrapper folding members movable along said faces for folding said severed sheet thereagainst.

9. The combination described in claim 8 in which said wrapper folding members are at least in part movably mounted on said box.

10. The combination with a baling press having a frame, opposed platens, a press box normally between said platens, and automatic strapping mechanism movable along said frame for applying banding transversely about a bale compressed between said platens, of means to apply sheets of wrapping material across the faces of said platens and extending peripherally therebeyond, means to separate said box at least in part from a bale compressed between said platens to expose faces of the bale, and folding members movably mounted on the press and actuable along exposed faces of the bale for folding said material thereacross.

11. The combination described in claim 10 further including folding members mounted on said strapping mechanism for movements at 90° to the directions of movement of said previously mentioned folding members and oppositely along opposed end faces of the compressed bale for folding the corner flaps of said material between previously folded side and end portions thereof.

12. The combination described in claim 10 in which said box is slidable endwise to clear the faces of the compressed bale and said first-mentioned folding members are mounted at least in part on said box.

13. The combination described in claim 10 further including banding head and band track means normally spaced from the bale and movable toward the bale to direct banding endwise around the bale and having a part engagable with the bale to hold the end folds of the wrapping material during the application of the banding.

14. The combination described in claim 12 further including structure at the top end of said box for supporting the extending edges of the lower of said wrapping sheets to control wrinkling thereof during folding.

15. The combination described in claim 11 further including foot elements spaced apart slightly less than the width of the bale and movable to press opposed extending portions of said lower wrapper sheet against said box top structure to resist uncontrolled wrinkling of said opposed portions during folding of the intervening extended portions.

16. A baling press having a frame, a press box movable in said frame, a control device carried by said box, energizing means for said device mounted adjacent said box, flexible conduit means connecting said energizing means and said device, and guide elements directing the travel of said conduit means to prevent interference between said conduit means and other parts of the press.

17. A baling press as described in claim 16 including a pair of side by side press boxes rotatably mounted in said frame.

18. A baling press as described in claim 16 further including framing rotatably mounted in said frame, said box being vertically movable in said framing.

19. A baling press as described in claim 18 including a pair of press boxes vertically movable in said framing, said guide means comprising a stationary member about which said conduit means may wind during rotation of said boxes.

20. A baling press as described in claim 19 in which said guide means further includes sheave wheels about which said conduit means travels between said stationary member and said boxes.

* * * * *

Disclaimer 3,962,846.—*Joseph C. Neitzel*, Sao Paulo, Brazil; *Ronald A. Tomlinson*, Garland; *Allen R. Hurst, Jr.*, Denison, Tex.; *Paul W. Bodovsky*, and *Arnold E. Krueger*, Sherman, Tex. APPARATUS FOR AUTOMATIC WRAPPING OF BALES. Patent dated June 15, 1976. Disclaimer filed Nov. 24, 1980, by the assignee, *Continental Conveyor and Equipment Company, Inc.*

Hereby enters this disclaimer to claims 1 through 20 of said patent.

[*Official Gazette March 10, 1981.*]